US005711563A

United States Patent [19]

Sapp

[11] Patent Number: 5,711,563

[45] Date of Patent: Jan. 27, 1998

[54] BAGGING APPARATUS AND METHOD

[76] Inventor: James R. Sapp, 7 Ivy Trail, Greenville, S.C. 29615

[21] Appl. No.: 551,772

[22] Filed: Nov. 7, 1995

[51] Int. Cl.[6] ..... B65B 67/12; B65F 1/06

[52] U.S. Cl. ..... 294/1.1; 248/99

[58] Field of Search ..... 294/1.1, 1.3, 1.4, 294/55; 15/257.1, 257.4, 257.7; 248/95, 97, 99–101; 141/108, 109, 313, 314, 390, 391; 383/13, 33

[56] References Cited

U.S. PATENT DOCUMENTS

| | | | |
|---|---|---|---|
| 3,426,958 | 2/1969 | Gore | 248/99 X |
| 3,779,496 | 12/1973 | Welles | 248/99 |
| 3,942,832 | 3/1976 | Haas | 294/55 |
| 4,023,842 | 5/1977 | Harvey | 294/1.1 |
| 4,530,533 | 7/1985 | Dieter | 294/1.1 |
| 4,723,803 | 2/1988 | Sapp | 294/1.1 X |
| 4,738,478 | 4/1988 | Bean | 294/1.1 X |
| 4,750,695 | 6/1988 | Greenhouse | 248/99 |
| 4,775,123 | 10/1988 | Borland et al. | 248/99 |
| 4,962,956 | 10/1990 | Scripter | 248/99 X |
| 5,228,654 | 7/1993 | Carpentier | 248/100 X |

*Primary Examiner*—Johnny D. Cherry
*Attorney, Agent, or Firm*—Ralph Bailey

[57] ABSTRACT

A bagging apparatus and method utilizes diverging arms (A) which extend first outwardly from a handle and thence downwardly forming a curved free outer end (B) for suspending and maintaining the bag in opened position when supported by the handle (C) for carrying a heavy load of trash or leaves without puncturing or tearing the bag. The attachment of the bag is facilitated through the use of an elastic cord (D) which entraps a cuff portion of an opened bag within converging slots (F) utilizing an enlarged portion of the elastic cord pinching the bag wedged into the slot for securement of a marginal portion of the bag within the slot.

13 Claims, 2 Drawing Sheets

BAGGING APPARATUS AND METHOD

BACKGROUND OF THE INVENTION

This invention relates to an improvement in the device of U.S. Pat. No. 4,723,803 including apparatus and method wherein an open end of a plastic bag is attached to a molded plastic hand-carried apparatus for maintaining the bag in open position to facilitate placement of leaves, trash and the like therein.

U.S. Pat. No. 3,942,832 discloses a circumferential frame for maintaining a bag in open position attached by an elastic cord received in a groove about the frame for confining the open end of the bag in the groove. U.S. Pat. No. 4,023,842 discloses a resilient metallic frame which is open at a free end and which relies upon the resiliency of the frame for maintaining the bag opened upon the diverging frame members. U.S. Pat. No. 4,048,691 illustrates the use of a triangular circumferential frame for maintaining a leaf bag in open position with a slidable member carried by the handle for engaging and stretching the bag to an open position.

Such devices have failed to satisfactorily perform in that the bags are either not securely positioned or such fail to present a desirable fully opened configuration with the lower edge being maintained for ground engagement for the reception of refuse therein.

Although U.S. Pat. No. 4,723,803 discloses an apparatus for holding open a bag for reception of leaves and trash, the problem of attaching an open end of the bag remained unsolved. The cord used to attach the bag to the device was not elastic, which means that the string was long and hard to handle, and the task of securely attaching the string remained difficult, requiring the use of a special fastener such as Velcro tabs. Moreover, the free ends of the arms were pointed so as to puncture the bag under the stress of a substantial load being suspended therefrom. This was thought necessary because the string was attached in an upper flat portion of the arms necessitating a pointed member over which the string must pass to the guide means on the arms. The bag was secured directly to the outside of the arms of the device, forcing the bag to support the weight of a load at only a few attachment points, and thus causing rips in the bag.

The instant invention has overcome these problems by using an elastic cord that is short enough in the unstretched position to be easily handled. The elastic cord secures the bag to the device by wedging a stretched portion of the cord over a marginal portion of the bag down into a slot, and allowing a free end of the cord to relax, thus entrapping the bag therein. Also, sharp or pointed edges that could puncture the bag have been removed from the device. A further advantage of the instant invention is that the bag fits inside of the opposed arms, and a cuff extends over the frame for securement onto the outside of the arms. This arrangement allows the weight of a load suspended in the bag to be distributed evenly along the top of the device, reducing the chance of rips in the bag at a point of attachment.

Accordingly, it is an important object of the invention to provide a device essentially in the shape of a trash receptacle of generally wishbone configuration to provide a flat ground engaging portion free of obstacles with an arcuate shaped opening for facilitating the placement of leaves and the like within the bag with improved fastening means facilitating positive securement of the bag in open position.

Another important object of the invention is the provision of improved apparatus and method for positively attaching a refuse bag in open position utilizing an elastic cord which is stretched for wedging a marginal portion of the bag into a slot with a free unstretched end of the elastic cord having returned to full diameter, entrapping the bag in wedged position.

SUMMARY OF THE INVENTION

An important object of the invention is to provide an improved apparatus and method for fastening a bag in open position on a bagging apparatus having opposed arms carried by a handle wherein an elastic cord is fastened adjacent each spaced end of each arm for stretching about the open end of the bag for positive securement in a generally continuous motion.

An elastic cord is fastened adjacent each spaced free end of each arm. Guide means are carried by the arms for positioning and securing the cord about an open edge of the plastic bag adjacent a flat outer surface releasably fastening the bag about the arms in open position for reception of leaves, trash and the like. An elastic cord passes about a guide means and is received by an open slot for wedging a marginal portion of the plastic bag therein. The elastic cord assumes a reduced cross-section when tensioned so as to wedge the marginal portion of the bag into the open slot, a portion of the elastic cord extending beyond the slot returning to its former larger cross-section upon being released so as to trap the bag in wedged position.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a molded plastic hand-carried apparatus for maintaining a plastic bag in open position to receive leaves, trash and the like. A pair of opposed arms A extend outwardly and down presenting a substantially flat circumferential outer upright surface affording a skirt about which an open edge of the plastic bag may be disposed with the bag being in open configuration to receive leaves, trash and the like. The flat surface maintains the plastic bag open at the top to receive leaves and has a narrow arcuate upper free end portion B and a flat ground engaging portion therebeneath holding the bag open between spaced free ends of the opposed arms. A handle C is carried at a juncture of the arms extending rearwardly and upwardly therefrom avoiding interference with the flat surface about which an open edge of a plastic bag may be disposed. The flat member forming the arms affords strength and rigidity with light weight, inexpensive construction. An elastic cord D is fastened adjacent each spaced opposed free end of each arm.

Guide means E are carried by the arms for positioning and securing the cord about an open edge of the plastic bag adjacent the flat outer surface, releasably fastening the bag about the arms in open position for reception of leaves, trash and the like. An open slot F is carried by each of the arms for receiving the elastic cords after passing about the guide means wedging a marginal portion of the plastic bag therein. The elastic cord assumes a reduced cross-section when tensioned so as to wedge the marginal portion of the bag into the open slot; a portion of the elastic cord extending beyond the slot returns to its former larger cross-section upon being released so as to trap the bag in wedged position. Thus, the plastic bag presents a substantially fully opened portion to facilitate reception of leaves through an opening defined by the arms.

Figure 1:
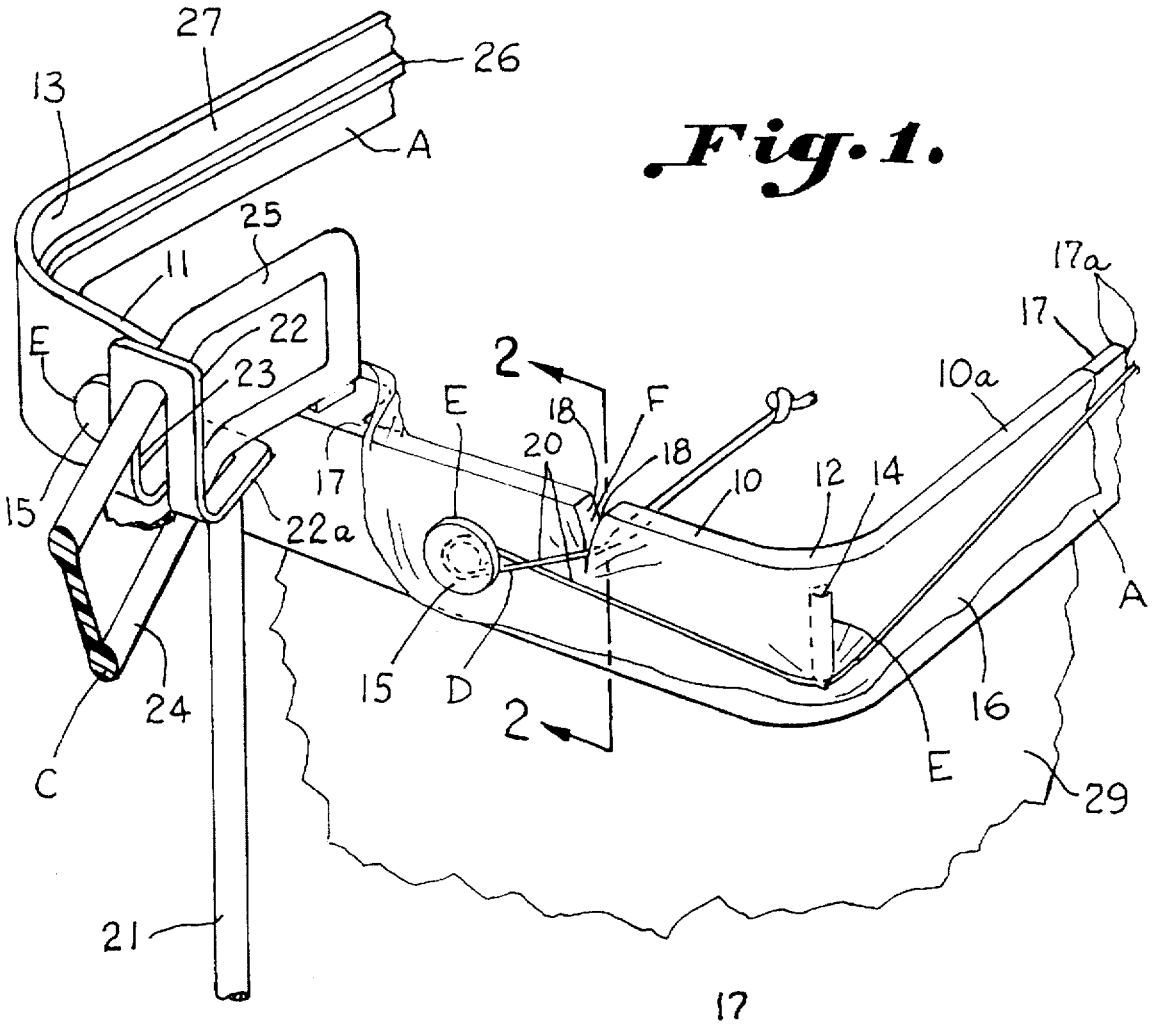
FIG. 1 is a perspective view looking downwardly toward the right side of bagging apparatus constructed in accordance with the invention wherein an elastic cord is passed over a cuff which has been folded over the flat outer surfaces of diverging arms and guided to a position for wedging the bag in an inwardly tapering slot for positive securement of the bag in open position.
Figures 4, 5:
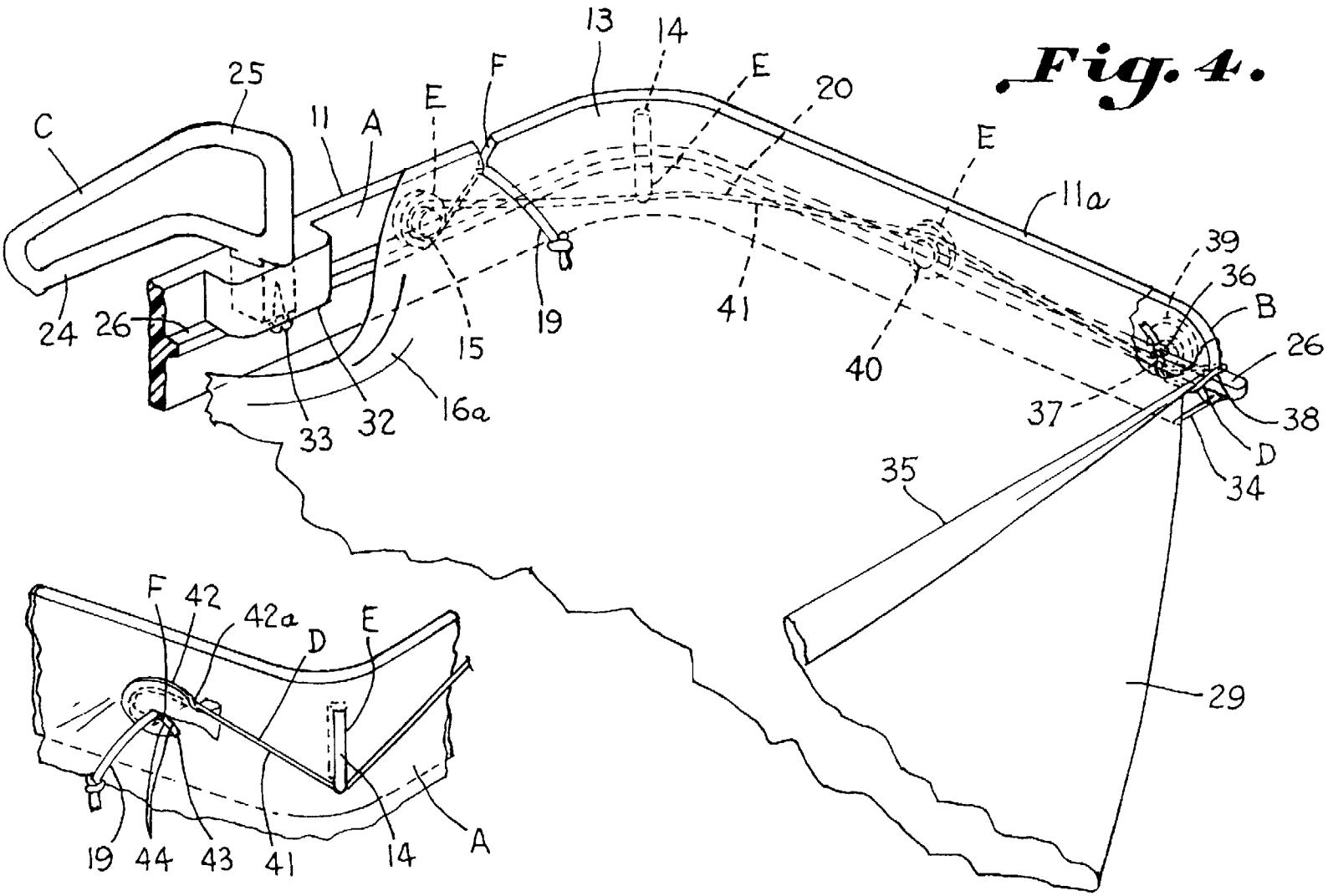
FIG. 4 is a perspective view looking downwardly and inwardly toward an arm and a handle attachment intermediate the arms with the bag held in a depending relation thereto preparatory to receiving leaves if placed on the ground or trash and the like illustrating an arcuate upper free end portion which facilitates suspending the bag under load to avoid puncturing or tearing the bag.
FIG. 5 is a perspective view similar to FIGS. 1 and 3 illustrating a modified form of the invention wherein an inwardly tapering slot is carried by a button-like guide member for wedging the cuff of the bag in trapped position within a converging slot and thus fastened to respective arms.

Referring more particularly to FIG. 1, it will be observed that the opposed arms A extend first outwardly and thence downwardly. The arms each have an arcuate upper free end portion B, as illustrated in FIG. 4. The arms A extend outwardly on each side of the handle C as at 10 and 11. The extensions 10 and 11 are joined with downward extensions 10*a* and 11*a*, respectively, and these sections are preferably joined by curved portions 12 and 13 to soften the generally rectangular opening configuration supplied for the placement of the open end of the bag by attachment to the arms A.

FIG. 1 illustrates a preferred form of the apparatus for attachment of the bags facilitated through the use of an elastic cord D, which is illustrated as passing first about the lower end of a vertical guide post 14 and thence over an upper guiding surface of guide means E provided in the form of a button 15. The elastic cord D is then illustrated as being passed over an outer cuff member 16 of the bag, which is folded over the flat member forming the arms A. A slot F is illustrated in FIG. 1 as opening in an upper surface 17 of an outwardly extending section 10. A similar slot (not shown) is provided in section 11 of the arm A, which diverges in the other direction from the handle C. The slot F is illustrated as having downwardly converging opposite sides 18 for wedging and trapping the cuff at both its inner and outer sides within the slot. After the elastic cord D and the marginal portion of the bag are wedged into the slot, an end 19 of the elastic cord is released causing it to assume its larger unstressed configuration as illustrated in FIG. 1 wherein the remainder of the elastic cord D is illustrated in its stretched reduced cross-section as shown at 20.

Also illustrated in FIG. 1 is a vertical support 21 carrying a bracket 22 thereon having a slot 23 for receiving an outer downward portion 24 of the handle C. An inner horizontal portion 25 of the handle rests against a horizontal flange 22*a* of the bracket 22 for supporting the device and the bag 29 which depends therefrom in open configuration at its upper end. FIG. 1 further illustrates the use of a longitudinal rib 26 running the entire length of an inner flat surface 27 of substantially the length of both arms.

Figure 2:
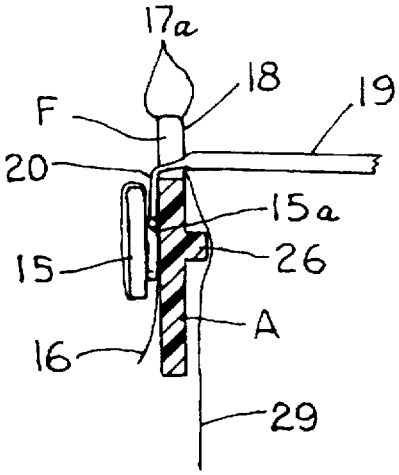
FIG. 2 is a transverse sectional elevation taken on the line 2—2 in FIG. 1 at an enlarged scale illustrating the wedging action of the elastic cord which entraps the cuff of the bag in the tapering slot.

FIG. 2 illustrates the enlarged free end 19 of the unstressed elastic cord D whereas the reduced, stretched portion 20 is illustrated as extending between the slot inwardly to the guide button at a 90° angle. The button-like member 15 is illustrated as having a circumferential cord receiving guide surface 15*a* thereabout.

It will also be noted that the upper edges of the arms have a radius or bevel at each edge as illustrated in 17*a* in FIGS. 1 and 2 in order to facilitate securement of the cuff formed in the marginal portion of the bag about the arms and maintaining the bags in suspended position on the arms.

Figure 3:
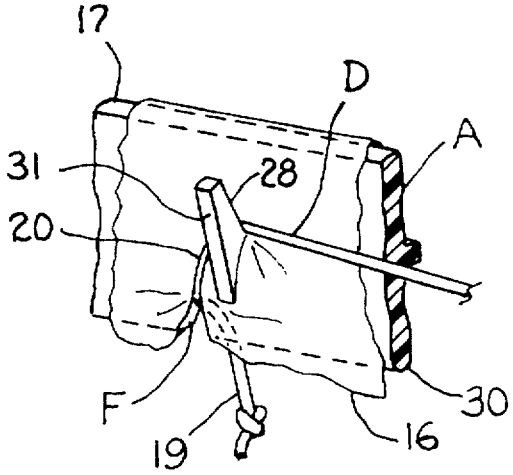
FIG. 3 is a perspective view with parts broken away illustrating a modified form of the invention wherein a guide is used to position the elastic cord at a 90° angle to a slot opening into a marginal surface of a flat member defining diverging arms for attaching a marginal portion of the bags.

The modified form of the invention illustrated in FIG. 3 shows the use of a protruding upwardly extending post 31 forming a V-shaped slot 28 therein for guiding a reduced portion 20 of the elastic cord into a slot F formed in a lower surface 30 of the arms A. Also illustrated is the enlarged tension-free end portion 19 which acts to trap the cuff portion of the bag in the slot for attachment thereto.

FIG. 4 illustrates a mode of attachment of the handle C which is molded separately from the arms A, upon a block 32 which is integral with the arms and wherein a threaded screw 33 is utilized to provide the attachment between the handle and the block. The bag is illustrated as being passed upwardly between the opposed arms A with the cuff 16, as illustrated in FIGS. 1–3, passing about the handle as at 16*a* so as to avoid the handle and over the free end of the arms including the arcuate free end portion B. The free end is also formed by an outwardly extending portion of the rib 26 together with a downwardly and inwardly extending surface 34 which lies flat against the ground supporting the bag apparatus and a free edge 35 of the bag 29 which is stretched between the free ends of the arms. One end of the elastic cord is secured as by the knot 36 on one side of an opening 37 in the inner circumferential rib 26 providing a first course 38 over a marginal portion of the bag at the downturned cuff and thence upwardly over a button-like guide member 39 toward the next succeeding button-like guide member 40 which is carried in the outwardly and downwardly extending section 11*a*, joined to an outwardly extending section 11. From thence, the stretched and reduced portion 20 passes in a course 41 beneath a vertical guidepost 14 to a button-like guide member 15 as described above.

If desired, the bag may be inserted from the outside preferably utilizing the fastening configuration as illustrated in FIG. 3. The modified form of the invention illustrated in FIG. 5 includes a button-like member 42 which is illustrated as being slightly oblong in a horizontal direction providing an upper groove 42*a* which extends beneath the button-like member 42 terminating at an end 43 thereof wherein the inwardly tapering slot F commences as defined between inwardly tapering sides 44.

In attaching a bag to the holder, a cuff is folded over one arm of the unit. While holding the cuff in place with one hand, the other hand is used to pull the cord up from the angled lower end of the arm and across the guide button at the end of the arm, keeping it fairly tight. While holding the cuff in place over the rear button, the cord is pulled tightly around the rear button (top to bottom) and locked in place by pulling it firmly into the cord slot at the top of the arm. With the thumb, the cord is moved downwardly of the guide post until it snaps into place at the bottom. Then a cuff is attached over the other arm in the same way.

Other uses of the bag device include aiding in picking up trash on the highway. The added convenience of the device to workers picking up highway trash allows workers to pick up trash without having to spin the bag. No spinning or twisting bags facilitates trouble-free filling. When used for janitorial purposes, this device speeds up transfer from waste baskets to a large bag. The device is maneuverable in tight corners, and allows the user to get the bag quick,to the source of trash for quick, spill-free transfers. It is excellent for trash or recycling when used with wall mount or free-standing holders as illustrated in FIG. 1. The device may be mounted to hold bags off the floor, making it easy to clean around and under, and is especially handy in workshop environments.

While a preferred embodiment of the invention has been described using specific terms, such description is for illustrative purposes only, and it is to be understood that changes and variations may be made without departing from the spirit or scope of the following claims.

What is claimed is:

1. A molded plastic hand carried apparatus for maintaining a plastic bag in open position to receive leaves, trash and the like comprising:

a pair of opposed arms extending outwardly and down;

said arms presenting a substantially flat outer surface affording a skirt about which an open edge of the plastic bag may be disposed with the bag being in open configuration to receive leaves, trash and the like;

an arcuate upper free end portion of said arms holding the bag open between spaced free ends of said arms;

a handle carried at a juncture of said arms extending rearwardly and upwardly therefrom avoiding interference with the flat surface about which an open edge of a plastic bag may be disposed;

an elastic cord held adjacent each said spaced free end of each arm;

guide means carried by said arms for positioning and securing said cord about an open edge of said plastic bag adjacent said flat outer surface releasably fastening said bag about said arms in open position for reception of leaves, trash and the like;

an open slot carried by said arms for receiving said elastic cord after passing about said guide means wedging a marginal portion of said plastic bag into said open slot; and said elastic cord assuming a reduced cross-section when tensioned so as to wedge said marginal portion of said bag into said open slot, a portion of said elastic cord extending beyond said slot returning to its former larger cross-section upon being released so as to trap said bag in wedged position;

whereby said plastic bag presents a substantially fully opened end portion to facilitate reception of leaves, trash and the like through an opening defined by said arms.

2. The structure set forth in claim 1 wherein a separate elastic cord is fastened adjacent each said free end, and wherein open slots carried by respective arms taper inwardly from an open outer end for receiving and confining a reduced tensioned portion of said cords and a bag portion wedged therein.

3. The structure set forth in claim 2 wherein said slots extend from an upper edge of respective arms and receive said cords at substantially a right angle to said guide means.

4. The structure set forth in claim 2 wherein said slots extend upwardly from a lower edge of respective arms and receive said cords as substantially a right angle to said guide means.

5. The structure set forth in claim 2 wherein said guide means include a button-like member on an outer surface of each arm having a curved recess receiving said cords, and an open slot in each button receiving said cord and wedging said bag.

6. The structure set forth in claim 1 wherein said elastic cord is attached to a rib on the inside of said opposed arms and passes over a flat ground engaging surface before attaching to said guide means.

7. A molded plastic hand carried apparatus for maintaining a plastic bag in open position to receive leaves, trash and the like comprising:

a pair of opposed arms extending outwardly and down;

said arms presenting a substantially flat outer surface affording a skirt about which an open edge of the plastic bag may be disposed with the bag being in open configuration to receive leaves, trash and the like;

an arcuate upper portion on each of said arms at respective ends thereof for holding the bag open therebetween;

a block for mounting a handle carried at a juncture of said arms extending rearwardly and upwardly therefrom avoiding interference with the flat surface about which an open edge of a plastic bag may be disposed; and guide means including a forward projection beneath said arcuate upper portion on each of said arms at respective ends thereof carried by said arms for positioning and securing an open edge of said plastic bag adjacent said flat outer surface releasably fastening said bag about said arms in open position for reception of leaves, trash and the like;

whereby said plastic bag presents and maintains a substantially fully opened end portion folded over the arms in a cuff so as to avoid puncturing said bag as upon prolonged suspension under the load imposed by a substantial content of leaves, trash and the like to facilitate reception of leaves, trash and the like through an opening defined by said arms.

8. The method of maintaining a plastic refuse bag in open position to receive leaves, trash and the like comprising the steps of:

positioning a marginal portion of an open refuse bag on a pair of diverging arms extending outwardly and downwardly for presenting a substantially flat member affording a skirt about which said marginal portion is disposed with the bag being in open configuration to receive leaves, trash and the like;

maintaining the bag open at the top with a marginal portion being held open between spaced free ends of said arms;

positioning a handle at a juncture of said arms avoiding interfering with the flat surface about which an open edge of the bag is disposed;

stretching an elastic cord held adjacent each of said spaced free ends of each arm;

stretching and passing said elastic cord about guides on said diverging arms over said open edge of said bag releasably fastening said bag about said arms beneath said cord in open position for reception of leaves, trash and the like;

wedging a marginal portion of said bag on each of said arms by passing said elastic cord over said marginal portion after passing about said guide means and while stretched;

reducing the cross-section of said elastic cord when so tensioned so as to secure said marginal portion of said bag to each of said arms; and releasing a portion of said elastic cord extending beyond said marginal portion returning same to its former larger cross-section upon being released so as to trap said bag in wedged position;

whereby said bag presents and maintains a substantially fully opened end portion folded over the arms in a cuff capable of facilitating reception of leaves, trash and the like through an opening thus defined by said arms.

9. The method set forth in claim 8 including the steps of passing said marginal portion inside the arms and folding same over said arm forming a marginal cuff extending over an outside surface of said substantially flat member.

10. The method set forth in claim 8 including the steps of passing said marginal portion outstanding the arms, and folding same over said arms forming a marginal cuff having a portion extending over an outside surface of said substantially flat member.

11. The method set forth in claim 8 including the step of positioning said handle and arms on a support with said refuse bag suspended therefrom for reception of leaves, trash and the like through the opening in the top of the bag until a desired amount of leaves, trash and the like is placed therein.

12. The method set forth in claim 8 including the step of beveling upper edges of said arms and curving outer free ends of each arm to avoid damaging the bag when suspended and containing leaves, trash and the like.

13. The method of maintaining a plastic refuse bag in open position to receive leaves, trash and the like comprising the steps of:

positioning a marginal portion of an open refuse bag on a pair of diverging arms extending outwardly and downwardly for presenting a substantially flat member affording a skirt about which said marginal portion is disposed with the bag being in open configuration to receive leaves, trash and the like;

maintaining the bag open at the top with a marginal portion being held open between spaced free ends of said arms;

positioning a handle at a juncture of said arms avoiding interfering with the flat surface about which an open edge of the bag is disposed;

stretching an elastic cord held adjacent each of said spaced free ends of each arm;

passing said elastic cord in stretched configuration about guides on said diverging arms over said open edge of said bag releasably fastening said bag about said arms beneath said cord in open position for reception of leaves, trash and the like;

wedging a marginal portion of said bag on each of said arms by passing said elastic cord over said marginal portion after passing about said guide means and while stretched;

fastening said elastic cord adjacent a free end to an attachment means on a respective arm when so tensioned about said guides so as to secure said marginal portion of said bag to each of said arms; and releasing said elastic cord so as to trap said bag in wedged position;

whereby said bag presents and maintains a substantially fully opened end portion folded over the arms in a cuff capable of facilitating reception of leaves, trash and the like through an opening thus defined by said arms.

* * * * *